US007804511B2

(12) United States Patent
Honobe et al.

(10) Patent No.: US 7,804,511 B2
(45) Date of Patent: Sep. 28, 2010

(54) IMAGE FORMING APPARATUS, EXPOSURE APPARATUS, IMAGE HOLDER, IMAGE FORMING METHOD, AND EXPOSING METHOD

(75) Inventors: Satoshi Honobe, Kanagawa (JP); Tomokazu Kurita, Kanagawa (JP); Shigeru Tanaka, Kanagawa (JP); Junichi Ozawa, Kanagawa (JP); Taro Mitsui, Kanagawa (JP); Yukihiro Ichiki, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/896,098

(22) Filed: Aug. 29, 2007

(65) Prior Publication Data

US 2008/0145103 A1 Jun. 19, 2008

(30) Foreign Application Priority Data

Dec. 8, 2006 (JP) ..... P2006-332368

(51) Int. Cl.

| | |
|---|---|
| ***B41J 2/385*** | (2006.01) |
| ***B41J 2/00*** | (2006.01) |
| ***B41J 2/41*** | (2006.01) |
| ***B41J 2/45*** | (2006.01) |
| ***B41J 2/435*** | (2006.01) |

(52) U.S. Cl. ..... 347/149; 347/117; 347/118; 347/130; 347/138; 347/152; 347/238; 347/245; 347/263

(58) Field of Classification Search ..... 347/238, 347/242, 245, 263

See application file for complete search history.

(56) References Cited

U.S. PATENT DOCUMENTS

| | | | | |
|---|---|---|---|---|
| 6,968,147 | B2 * | 11/2005 | Matsuda et al. | 399/258 |
| 2005/0206714 | A1 * | 9/2005 | Greiser | 347/108 |

FOREIGN PATENT DOCUMENTS

| | | | |
|---|---|---|---|
| JP | 7-195734 | | 8/1995 |
| JP | 07195734 | A * | 8/1995 |
| JP | 2005-115236 | | 4/2005 |
| JP | 2006-84637 | | 3/2006 |

* cited by examiner

*Primary Examiner*—Matthew Luu
*Assistant Examiner*—Kendrick X Liu
(74) *Attorney, Agent, or Firm*—Morgan, Lewis & Bockius LLP

(57) ABSTRACT

An image forming apparatus includes: an image holder; an exposure member that has an exposure portion exposing the image holder; a first positioning unit that determines a distance in a first direction, which is a direction of an optical axis of the exposure member, between the exposure member and the image holder; and a second positioning unit that determines a position of the exposure member with respect to the image holder in a second direction being a direction of an axis line of the image holder, and a position of the exposure member with respect to the image holder in a third direction being perpendicular to both the first direction and the second direction, and that determines the distance between the exposure member and the image holder at a position substantially closer to the exposure member than the position of the first positioning unit.

7 Claims, 13 Drawing Sheets

IMAGE FORMING APPARATUS, EXPOSURE APPARATUS, IMAGE HOLDER, IMAGE FORMING METHOD, AND EXPOSING METHOD

CROSS-REFERENCE TO RELATED APPLICATIONS

This application is based on and claims priority under 35 U.S.C. 119 from Japanese Patent Application No. 2006-332368 filed Dec. 8, 2006.

BACKGROUND

1. Technical Field

The present invention relates to an image forming apparatus, an exposure apparatus, an image holder, an image forming method, and an exposing method.

2. Related Art

An apparatus employing light emitting element array, in which light emitting elements, such as LEDs, are disposed in a line, has been proposed as an exposure apparatus that exposes an image on an image holder, such as a photoreceptor drum, in an image forming apparatus, such as a printer and a copier, employing an electrophotographic method.

SUMMARY

According to an aspect of the present invention, an image forming apparatus includes: an image holder; an exposure member that has an exposure portion exposing the image holder; a first positioning unit that determines a distance in a first direction, which is a direction of an optical axis of the exposure member, between the exposure member and the image holder; and a second positioning unit that determines a position of the exposure member with respect to the image holder in a second direction being a direction of an axis line of the image holder, and a position of the exposure member with respect to the image holder in a third direction being perpendicular to both the first direction and the second direction, and that determines the distance between the exposure member and the image holder at a position substantially closer to the exposure member than the position of the first positioning unit.

BRIEF DESCRIPTION OF THE DRAWINGS

Exemplary embodiment of the present invention will be described in detail based on the following figures, wherein.

DETAILED DESCRIPTION

Hereinafter, an embodiment of the invention is described in detail with reference to the accompanying drawings.

Figure 1:
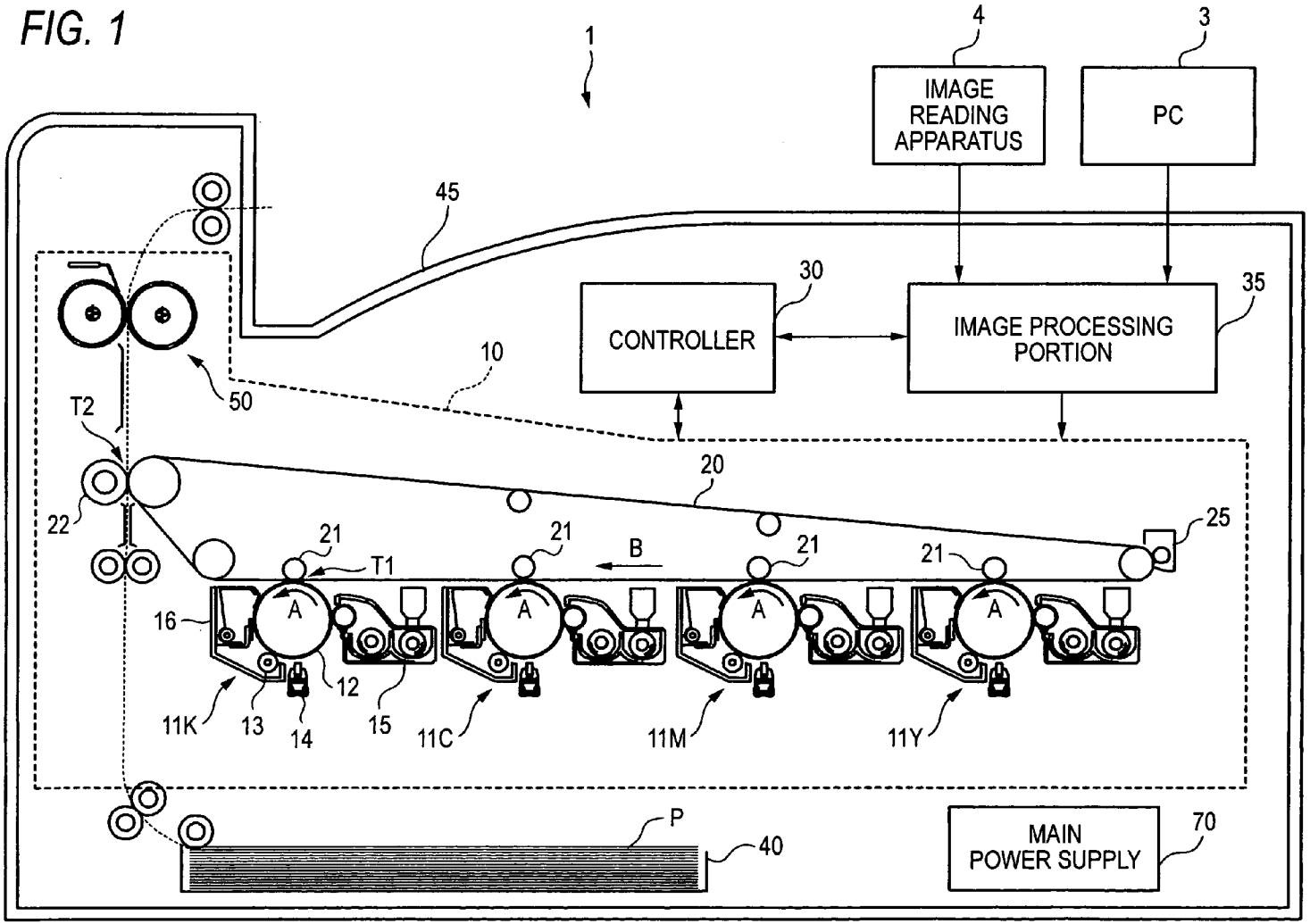
FIG. 1 is a view illustrating an example of the entire configuration of an image forming apparatus to which the invention is applied.

FIG. 1 illustrates an example of the entire configuration of an image forming apparatus 1 to which the present embodiment of the invention is applied. The image forming apparatus 1 illustrated in FIG. 1 is a digital color printer of what is called the tandem type. The image forming apparatus 1 includes an image formation processing portion 10 configured to perform image formation corresponding to image data of each color, a controller 30 configured to control an operation of the entire image forming apparatus 1, an image processing portion 35 which is connected to external apparatuses, for example, a personal computer (PC) 3 and an image reading apparatus 4 and which performs predetermined image processing on image data received from the external apparatuses, and a main power supply 70 configured to supply electric power to each of the portions.

The image formation processing portion 10 has four image forming units 11Y, 11M, 11C, and 11K disposed in parallel at predetermined intervals (hereunder referred to generically and simply as "image forming units 11"). Each of the image forming units 11 includes a photoreceptor drum 12 serving as an image holder that generates an electrostatic latent image and holds a toner image, an electrification unit 13 that uniformly electrifies a surface of the photoreceptor drum 12 at a predetermined electric potential level, an LED print head (LPH) 14 that is an example of an exposure apparatus (or exposure member) that exposes the photoreceptor drum 12 electrified by the electrification unit 13 according to image data, a developing unit 15 that develops the electrostatic latent image formed on the photoreceptor drum 12, and a cleaner 16 that cleans the surface of the photoreceptor drum 12 after the transfer of a toner image.

Each of the image forming units 11 is substantially similarly constituted except for toner accommodated in the developing unit 15. The image forming units 11 form an yellow (Y) toner image, a magenta (M) toner image, a cyan© toner image, and a black (K) toner image, respectively.

Additionally, the image formation processing portion 10 has an intermediate transfer belt 20 onto which toner images formed by the photoreceptor drums 12 of the image forming units 11 are multiply-transferred, a primary transfer roll 21 that sequentially transfers (or primarily transfers) toner images respectively formed by the image forming units 11 onto the intermediate transfer belt 20, a secondary transfer roll 22 that collectively transfers (or secondarily transfers)

toner images, which are superposed on the intermediate transfer belt 20, to paper P serving as a recording material (or recording paper), and a fixing unit 50 that fixes the secondary-transferred image onto the paper P.

Incidentally, in each of the image forming units 11, the photoreceptor drum 12, the electrification unit 13, and the cleaner 16 are integrally configured as a module (hereunder referred to as a "photoreceptor module MOD") serving as an image holder unit. Additionally, the photoreceptor module MOD is configured attachably to and detachably from the image forming apparatus 1. The photoreceptor module MOD can be replaced with another according to the lifetime of the photoreceptor drum 12. Incidentally, the photoreceptor module MOD can employ a configuration formed by including only the photoreceptor drums 12, or a configuration formed to be integral with the above composing elements and the developing units 15. That is, as long as the photoreceptor module MOD includes the photoreceptor drums 12 each of which has a lifetime shorter than those of the other composing elements, the photoreceptor module MOD can be constituted by a combination of any composing elements. However, the present embodiment assumes that the photoreceptor module MOD is formed separately from the LPH 14.

Additionally, the LPH 14 is configured by an approaching/separating mechanism (i.e., a retracting mechanism), which will be described later, to be contactable with and sepratable from the photoreceptor drum 12 between a predetermined position (i.e., an exposure position) at each exposure of the photoreceptor drum 12, which is set when an image is formed, and a position separated from the photoreceptor drum 12, which is set, for example, at the attachment/detachment of the photoreceptor module MOD.

In the image forming apparatus 1 according to the present embodiment, the image formation processing portion 10 performs an image forming operation according to various controls signals supplied from the controller 30. That is, the image processing portion 35 performs image processing on image data input from the PC 3 and the image reading apparatus 4 under the control of the controller 30. The processed image data is supplied to each of the image forming units 11 through an interface (not shown). Then, for example, in the image forming unit 11K corresponding to black (K), the photoreceptor drum 12 is uniformly electrified at a predetermined potential level by the electrification unit 13 while rotating in the direction of arrow A. The LPH 14 adapted to emit light according to the image data transmitted from the image processing portion 35 exposes the photoreceptor drum 12. Consequently, an electrostatic latent image corresponding to a black (K) image is formed on the photoreceptor drum 12. Then, the electrostatic latent image formed on the photoreceptor drum 12 is developed by the developing unit 15. Thus, a black (K) toner image is formed on the photoreceptor drum 12. Similarly, a yellow (Y) toner image, a magenta (M) toner image, and a cyan (C) toner image are formed in the image forming units 11Y, 11M, and 11C, respectively.

The color toner images formed in the image forming units 11 are sequentially and electrostatically attracted on the intermediate transfer belt 20, which moves in the direction of arrow B, by the primary rolls 21 to thereby form a synthetic toner image on which the color toner images are superposed. The synthetic toner image formed on the intermediate transfer belt 20 is conveyed to a region (i.e., a secondary transfer portion T2) as the intermediate transfer belt 20 moves. Paper P is supplied to the secondary transfer portion T2 from a paper holding portion 40 in synchronization with timing with which the toner image is conveyed to the secondary transfer portion T2. Then, the synthetic toner images are collectively and electrostatically transferred by a transfer electric field generated by the secondary transfer rolls 22 in the secondary transfer portion T2 onto the conveyed paper P.

Subsequently, the paper P onto which the synthetic toner image is electrostatically transferred, is peeled off the intermediate transfer belt 20 and is conveyed to the fixing unit 50 through a conveyance guide 23. The synthetic toner image on the paper P conveyed to the fixing unit 50 is fixed by the fixing unit 50 by undergoing a fixing process using heat and pressure. Then, the paper P, on which the fixed image is formed, is conveyed to a paper loading portion 45 provided in a discharge portion of the image forming apparatus 1.

On the other hand, upon completion of the secondary transfer, toner (i.e., transfer residual toner) adhering to the intermediate transfer belt 20 is removed for the next image formation cycle by a belt cleaner 25 from the surface of the intermediate transfer belt 20.

Thus, the image forming apparatus 1 iteratively performs image formation a plurality of times the number of which is equal to that of printed images.

Figure 2:
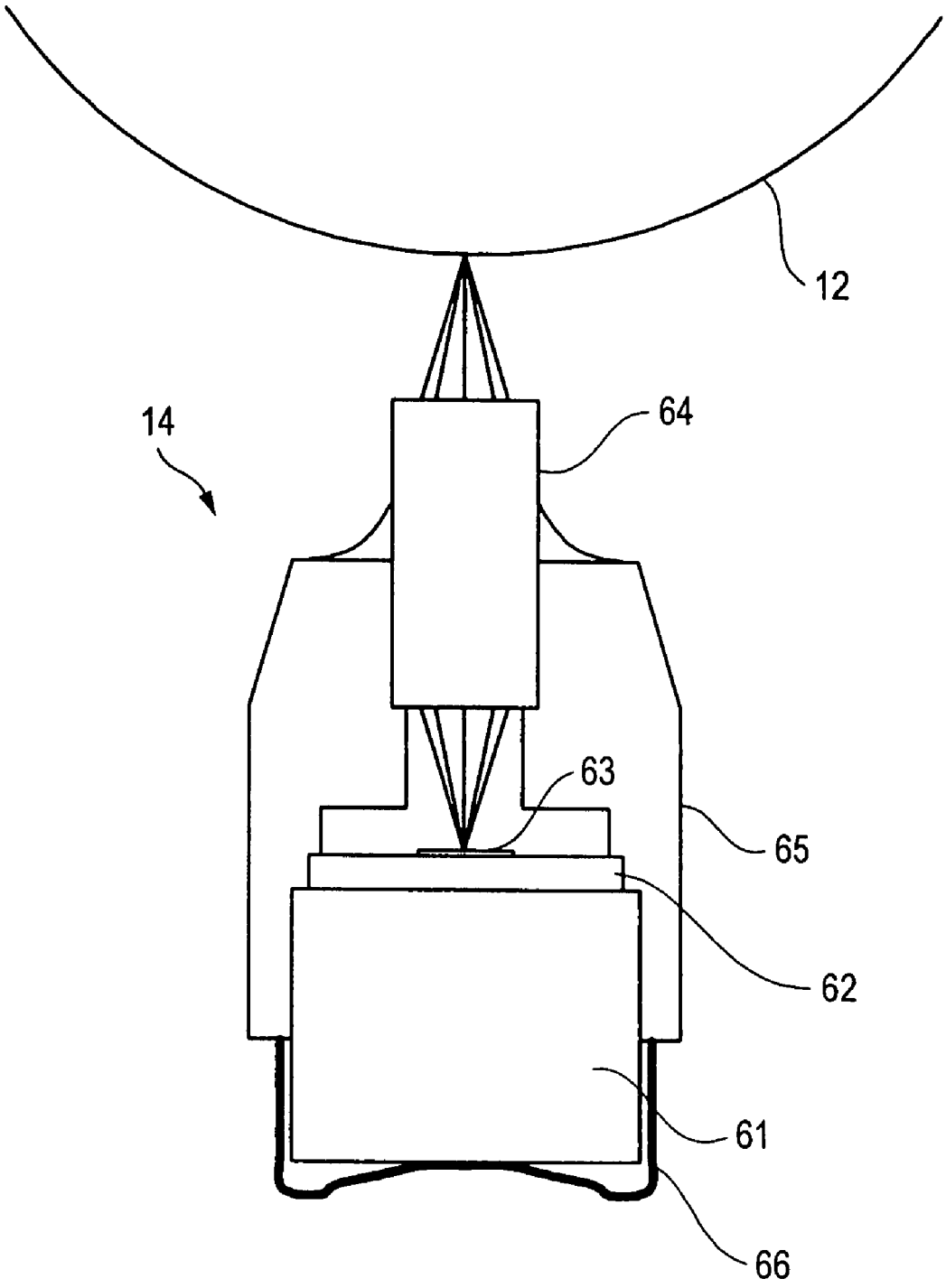
FIG. 2 is a view illustrating the configuration of an LED print head (LPH)

FIG. 2 is a cross-sectional view illustrating the configuration of the LED print head (LPH) 14 serving as the exposure apparatus. As shown in FIG. 2, the LPH 14 has a housing 61 serving as a support body, an LED array (LED) 63 serving as an example of a light source, an LED circuit board on which the LED 63 and a signal generating circuit 100 adapted to generate drive signals according to which the LED 63 is driven, a rod lens array 64 serving as an example of an optical member forming an image on a surface of the photoreceptor drum 12 from light emitted by the LED 63, a holder 65 configured to support the rod lens array 64 and to shield the LED 63 from the outside, and a plate spring 66 configured to press the housing 61 in the direction of the rod lens array 64.

The housing 61 is formed of a metal block made of aluminum or SUS or formed of a sheet metal and supports the LED circuit board 62. The holder 65 supports the housing 61 and the rod lens array 64 and sets the luminous point of the LED 63 to coincide with a focal plane of the rod lens array 64. The holder 65 is configured to seal the LED 63. Consequently, dust is prevented from externally adhering to the LED 63. On the other hand, the plate spring 66 presses the LED circuit board 62 through the housing 61 in the direction of the rod lens array 64 to hold the positional relation between the LED 63 and the rod lens array 64.

The LPH 14 constituted in this manner is configured to be able to move in the direction of the optical axis of the rod lens array 64 by an adjustment screw. The LPH 14 is adjusted so that an imaging location (i.e., a focal plane) is positioned on the photoreceptor drum 12.

Figure 3:
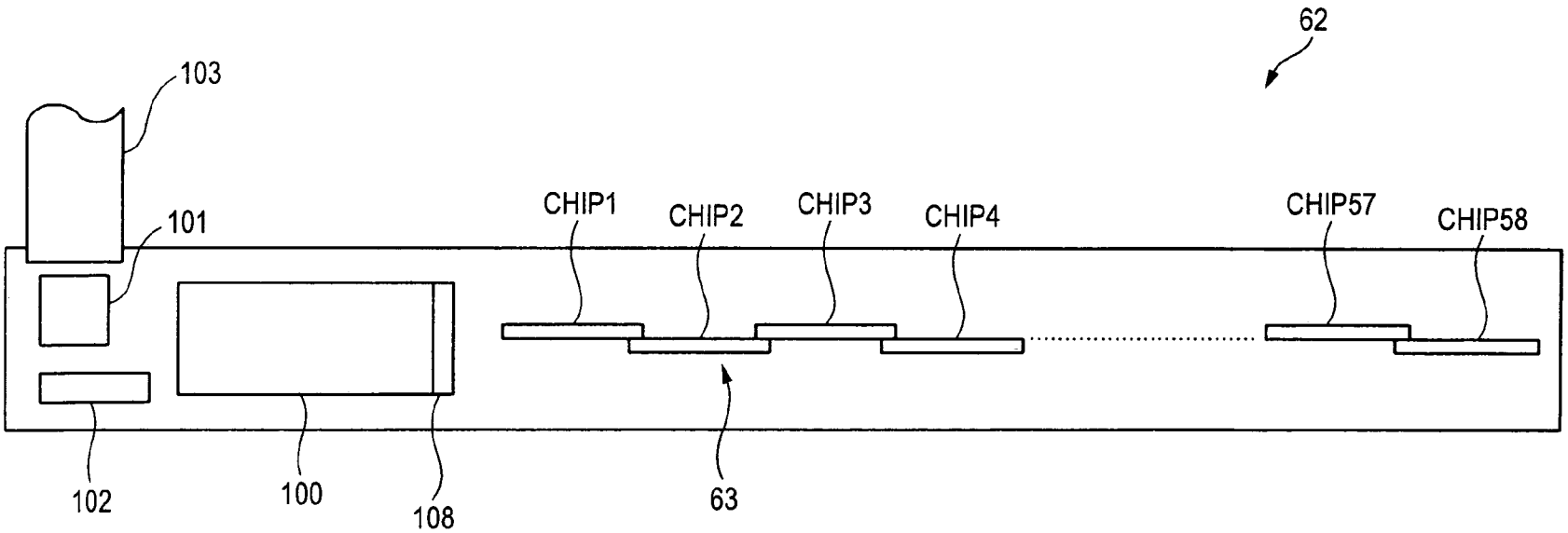
FIG. 3 is a plan view illustrating an LED circuit board.

As illustrated in FIG. 3 which is a plan view of the LED circuit board 62, the LED 63 including, for example, 58 LED chips CHIP1 to CHIP58 is disposed in a line with good accuracy, which is parallel to an axial direction of the photoreceptor drum 12. In this case, the LED chips CHIP1 to CHIP58 are disposed in a zigzag alignment to be continuous at end boundary portions of arrays (i.e., LED arrays) of light emitting devices (LED) disposed on each of the LED chips CHIP1 to CHIP58.

Also, a signal generating circuit 100 configured to generate signals (i.e., drive signals) to the LED 63, a level shift circuit 108, a 3-terminal regulator 101 adapted to output a predetermined voltage, an EEPROM 102 adapted to store light-amount-correction data of the LED 63, and a harness 103 that is supplied with electric power from the main power supply 70 and that is used for the transmission/reception of signals between the controller 30 and the image processing portion 35 are mounted on the LED circuit board 62.

Figure 4:
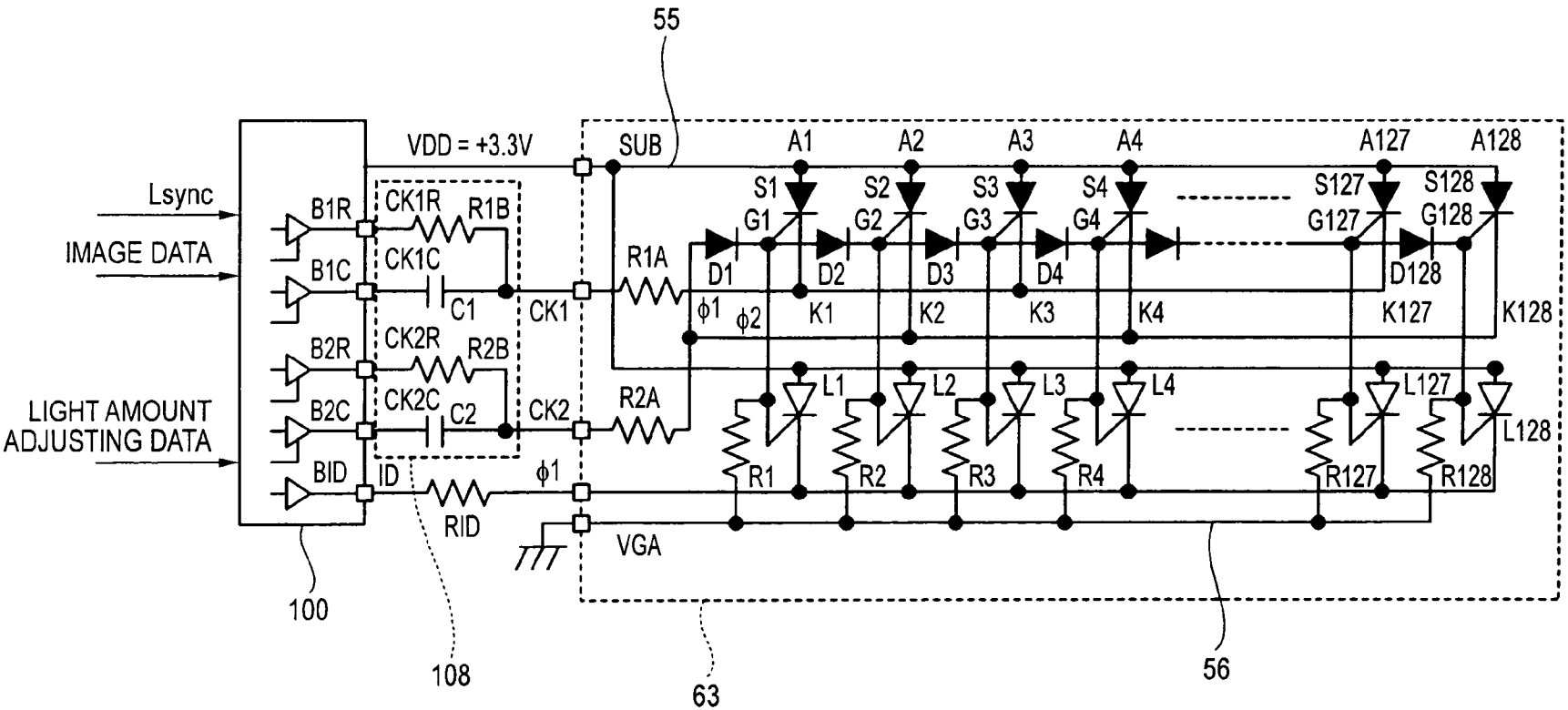
FIG. 4 is a view illustrating an LED.

FIG. 4 illustrates the LED 63. The LED 63 according to the present embodiment is supplied with various drive signals from the signal generating circuit 100 and the level shift circuit 108. That is, the signal generating circuit 100 generates transfer signals CK1R, CK1C, CK2R and CK2C, according to which the LEDs arranged in the LED array 63 are sequentially put into a lightable state, and lighting signals ϕI according to which the LEDs are sequentially turned on in accordance with image data sent from the image processing portion 35. Additionally, the signal generating circuit 100 outputs the transfer signals CK1R, CK1C, CK2R and CK2C to the level shift circuit 108 and also outputs the lighting signals ϕI to the LED array 63.

The level shift circuit 108 has a configuration in which a resistor R1B and a capacitor C1 are disposed in parallel to each other, and in which a resistor R2B and a capacitor C2 are disposed in parallel to each other. One end of each of the resistor R1B, the capacitor C1, the resistor R2B, and the capacitor C2, is connected to an input terminal of the LED array 63. The other end of each of the resistor R1B, the capacitor C1, the resistor R2B, and the capacitor C2, is connected to an output terminal of the LED array 63. The level shift circuit 108 generates the transfer signal CK1 according to the transfer signals CK1R and CK1 output from the signal generating circuit 100 and outputs the generated transfer signal CK1. Also, the level shift circuit 108 generates the transfer signal CK1 according to the transfer signals CK1R and CK1C output from the signal generating circuit 100 and outputs the generated transfer signal CK1 to the LED array 63. Additionally, the level shift circuit 108 generates the transfer signal CK2 according to the transfer signals CK2R and CK2C output from the signal generating circuit 100 and outputs the generated transfer signal CK2 to the LED array 63.

On the other hand, the LED array 63 according to the present embodiment includes, for example, 128 thyristors S1 to S128 serving as switching devices, 128 LEDs L1 to L128 serving light emitting devices, 128 diodes D1 to D128, 128 resistors R1 to R128, and current limiting resistors R1A and R2A adapted to prevent excessive currents from flowing through signal lines ϕ1 and ϕ2, respectively, as main composing elements thereof.

The anode terminals (i.e., the input terminals) A1 to A128 of the thyristors S1 to S128 are connected to a power supply line 55. The thyristors S1 to S128 are supplied with a drive voltage VDD (VDD=+3.3V) from the 3-terminal regulator 101 (see FIG. 3) through the power supply line 55.

On the other hand, the gate terminals (i.e., the control terminals) G1 to G128 of the thyristors S1 to S128 are connected to a power supply line 56 through resistors R1 to R128 respectively provided corresponding to the thyristors S1 to S128. Thus, the thyristors S1 to S128 are grounded (GND) through the power supply line 56.

Transfer signals CK1 from the signal generating circuit 100 and the level shift circuit 108 are sent through the transfer current limiting resistor R1A to the cathode terminals (i.e., the output terminal) K1, K3, . . . , K127 of the odd-numbered thyristors S1, S3, . . . , S127, respectively. Also, transfer signals CK2 from the signal generating circuit 100 and the level shift circuit 108 are sent through the transfer current limiting resistor R2A to the cathode terminals (i.e., the output terminal) K2, K4, . . . , K128 of the odd-numbered thyristors S2, S4, . . . , S128, respectively.

Additionally, the cathode terminals of the LEDs L1 to L128 are connected to the signal generating circuit 100. Thus, the lighting signals ϕI are sent to the LEDs L1 to L128.

The signal generating circuit 100 according to the present embodiment sets the signal level of each of the transfer signals CK1R and CK1C and the transfer signals CK2R and CK2C to change from a high level (hereunder described as "H") to a low level (hereunder described as "L") with predetermined timing, and then change from "L" to "H" with predetermined timing. Consequently, the potential level of the transfer signal CK1 output from the level shift circuit 108 is set to repeatedly change from "H" to "L" and then from "L" to "H". Also, the potential level of the transfer signal CK2 output from the level shift circuit 108 alternately with the transfer signal CK1 is set to repeatedly change from "H" to "L" and then from "L" to "H". Thus, for example, in each of the LED chips, the odd-numbered thyristors S1, S3, . . . , S127 are sequentially caused in this order to perform a transfer operation of turning off, turning on, and turning off, . . . . Similarly, the even-numbered thyristors S2, S4, . . . , S128 are sequentially caused in this order to perform a transfer operation of turning off, turning on, and turning off, . . . . Consequently, the thyristors S1 to S128 are serially caused in the order of S1, S2, . . . , S127, and S128 to perform a transfer operation of turning off, turning on, and turning off, . . . . Also, the lighting signal ϕI is output in synchronization with the transfer operation. Consequently, the LEDs L1 to L128 are sequentially turned on in the order of L1, L2, . . . , L127, and L128.

Thus, in the LPH 14 according to the present embodiment, the LEDs L1 to L128 of each of all the LED chips HIP1 to CHIP58 provided on the LED circuit board 62 are turned on in the order of L1, L2, . . . , L127, and L128. Thus, a scanning exposure is performed on the photoreceptor drum 12 according to image data.

In this case, it is necessary that the exposure from the LPH 14 is performed in parallel to the axis line of the photoreceptor drum 12 to prevent skew and distortion from occurring in a formed image. Thus, when the LPH 14 is provided in the image forming apparatus 1, it is requested to highly accurately perform the positioning of the exposure portion with respect to the axis line of the photoreceptor drum 12. In a case where the image holder has a cylindrical shape like the photoreceptor drum 12 according to the present embodiment, the axis line of the photoreceptor drum 12 (corresponding to the image holder) is the centerline of the rotating shaft 121 (see FIG. 5 which will be described later) of the photoreceptor drum 12. Also, for example, in a case where the photoreceptor (a belt photoreceptor) has a belt-shaped image holder and where exposures is performed on a planar portion of the belt photoreceptor, a line which is perpendicular to a direction of movement of a surface of the belt photoreceptor and is directed in a direction parallel to a surface of the belt photoreceptor in an exposure region is the axis line of the photoreceptor drum 12.

Next, the positioning mechanism for the LPH 14 in the image forming apparatus 1 according to the present embodiment is described below.

Figure 5:
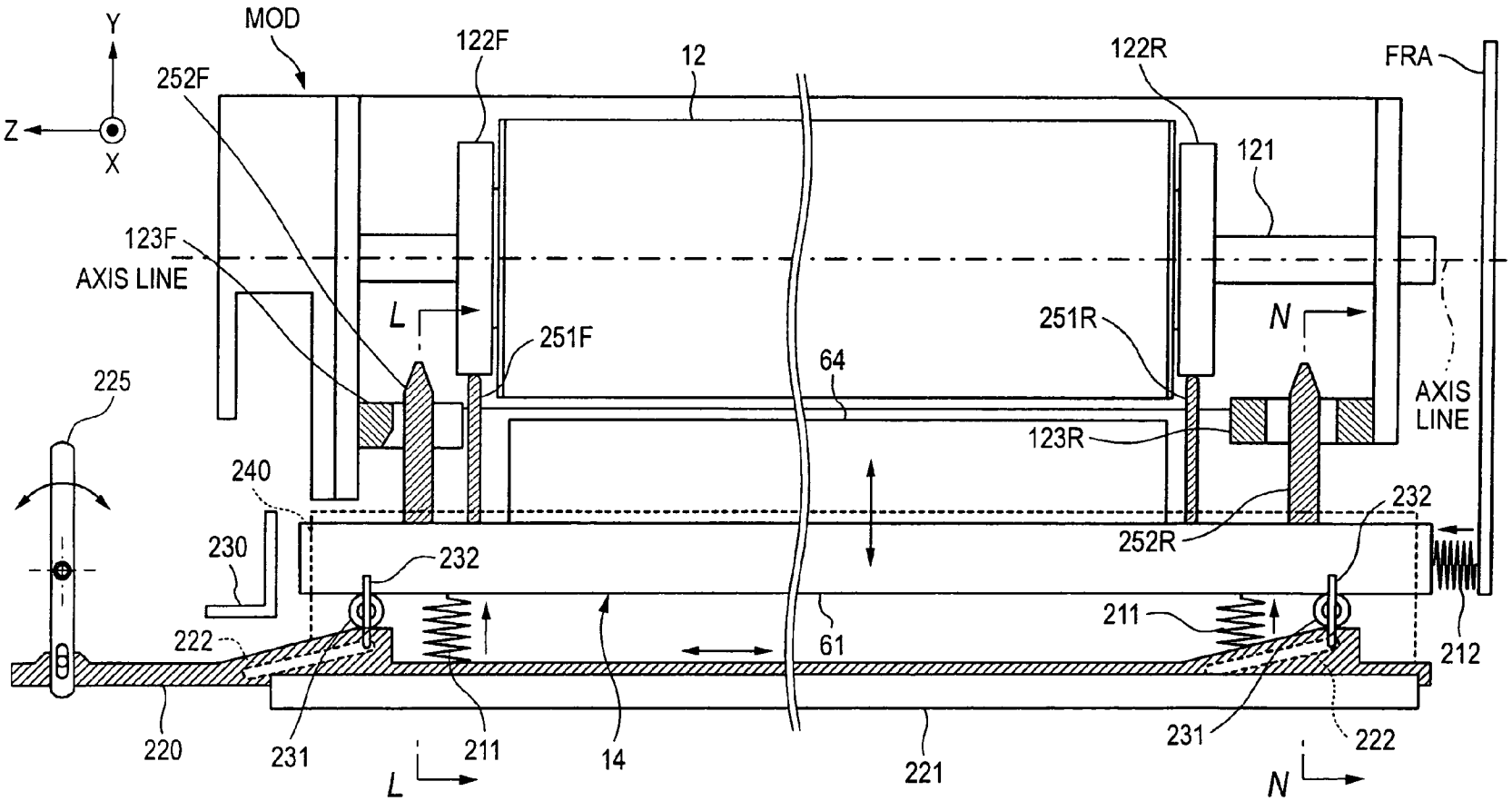
FIG. 5 is a view illustrating an LPH positioning mechanism.

FIG. 5 is a view illustrating the positioning mechanism for the LPH 14 according to the present embodiment. A left-side part of FIG. 5 is a front side of the image forming apparatus 1, at this side of which a detachment/detachment operation is performed on the photoreceptor module MOD. A right-side part of FIG. 5 is a rear side of the image forming apparatus 1, at this side of which a driving force of a drive motor adapted to rotationally drive the photoreceptor drum 12 is transmitted thereto. Incidentally, in the present specification, character "F" is suffixed to a number designating a member disposed at the front side of the image forming apparatus 1. Character "R" is suffixed to a number designating a member disposed at the rear side of the image forming apparatus 1.

As illustrated in FIG. 5, in the housing 61 of the LPH 14 according to the present embodiment, the first projection members 251F and 251R serving examples of the first projection portion configured to determine the position in the direction of the optical axis (i.e., the first direction which is defined to be a "Y-direction") of the rod lens array 64 of the LPH 14 are disposed. Also, the second projection members 252F and 252R serving examples of the second projection portion and the third projection portion configured to simultaneously determine the position in the direction of the axis line (i.e., the second direction which is defined to be the "Z-direction") and the position in the direction (i.e., the third direction which is defined to be an "X-direction") perpendicular to both the Y-direction and the Z-direction are disposed.

On the other hand, in the photoreceptor module MOD supporting the photoreceptor drum 12 according to the present embodiment, the Y-direction support members 122F and 122R serving as examples of the first support portion configured to set the Y-direction position of the LPH 14 by causing the first projection members 251F and 251R provided at the side of the LPH 14 to abut against the Y-direction support members 122F and 122R, respectively, are disposed coaxially with the rotating shaft 121 of the photoreceptor drum 12. Also, the XZ-direction support members 123F and 123R serving as examples of the second and third support portions configured to simultaneously set the X-direction position and the Z-direction position of the LPH 14 by supporting the second projection members 252F and 252R at the side of the LPH 14 serving as examples of the second and third projection portions are disposed.

Further, in the image forming apparatus 1 according to the present embodiment, the first projection member 251F and the Y-direction support member 122F constitute the first positioning means configured to set the Y-direction position of the LPH 14. Similarly, the first projection member 251R and the Y-direction support member 122R constitute the first positioning means.

Also, the second projection member 252F and the XZ-direction support member 123F constitute the second positioning means configured to simultaneously set the X-direction position and the Z-direction position of the LPH 14. Similarly, the second projection member 252R and the XZ-direction support member 123R constitute the second positioning means.

Figure 6:
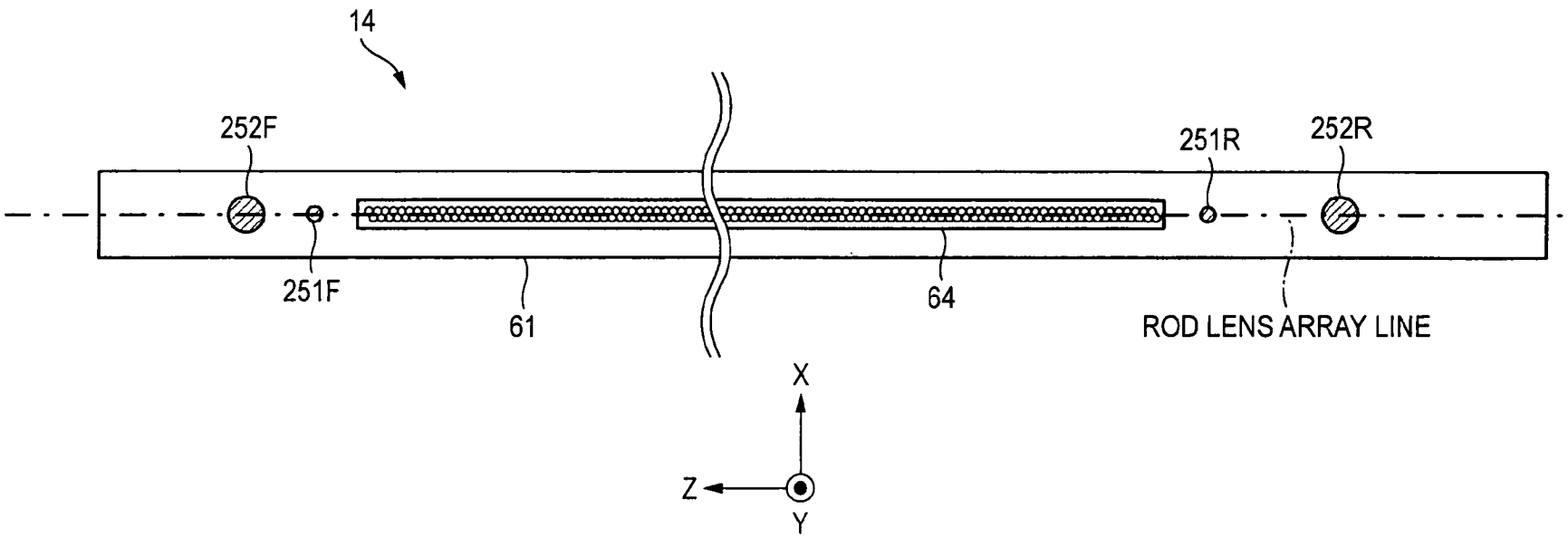
FIG. 6 is a plan view illustrating positions at which first projection members and second projection members are respectively disposed.

Next, FIG. 6 is a plan view illustrating the placement positions of the first projection members 251F and 251R and the second projection members 252F and 252R of the LPH 14 of the present embodiment. In the LPH 14, each of the first projection members 251F and 251R and the second projection members 252F and 252R is constituted by a cylindrical member having a predetermined outside diameter. The first projection members 251F and 251R and the second projection members 252F and 252R are provided to protrude perpendicularly to a surface of the housing 61, which faces the photoreceptor drum 12. The first projection members 251F and 251R and the second projection members 252F and 252R are disposed so that the center axis of each of the first projection members 251F and 251R and the second projection members 252F and 252R coincides with the array line of the rod lens array 64 arranged in a direction that coincides with a direction in which the LED chips CHIP1 to CHIP58 are arranged.

The first projection members 251F and 251R are disposed closer to the rod lens array 64 than the second projection members 252F and 252R. Thus, when the Y-direction support members 122F and 122R provided at the photoreceptor module MOD abut against the first projection members 251F and 251R (see also FIG. 5), the first projection members 251F and 251R serve as supporting points to prevent the rod lens array 64 from being bowed by the pushing force of the lifting spring 211. Incidentally, it is preferable from such a viewpoint that each of the lifting springs 211 is disposed in the vicinity of the position, at which an associated one of the first projection members 251F and 251R is disposed, or at a place closer to the rod lens array 64 than this position.

When the image forming apparatus 1 performs an image forming operation, the LPH 14 is set at the predetermined exposure position, at which the exposure is performed on the photoreceptor drum 12, by an approaching/separating mechanism (i.e., a retracting mechanism), which will be described in detail later. FIG. 5 illustrates a state in which the LPH 14 is set at this exposure position. In the image forming apparatus 1 according to the present embodiment, in a state in which the LPH 14 is set at the exposure position, the first projection members 251F and 251R are configured to abut against the Y-direction support members 122F and 122R, respectively. Thus, the Y-direction position of the LPH 14 is set. Also, the second projection members 252F and 252R at the side of the LPH 14 are configured to support the XZ-direction support members 123F and 123R. Consequently, the X-direction position and the Z-direction position of the LPH 14 are simultaneously set.

Figure 7:
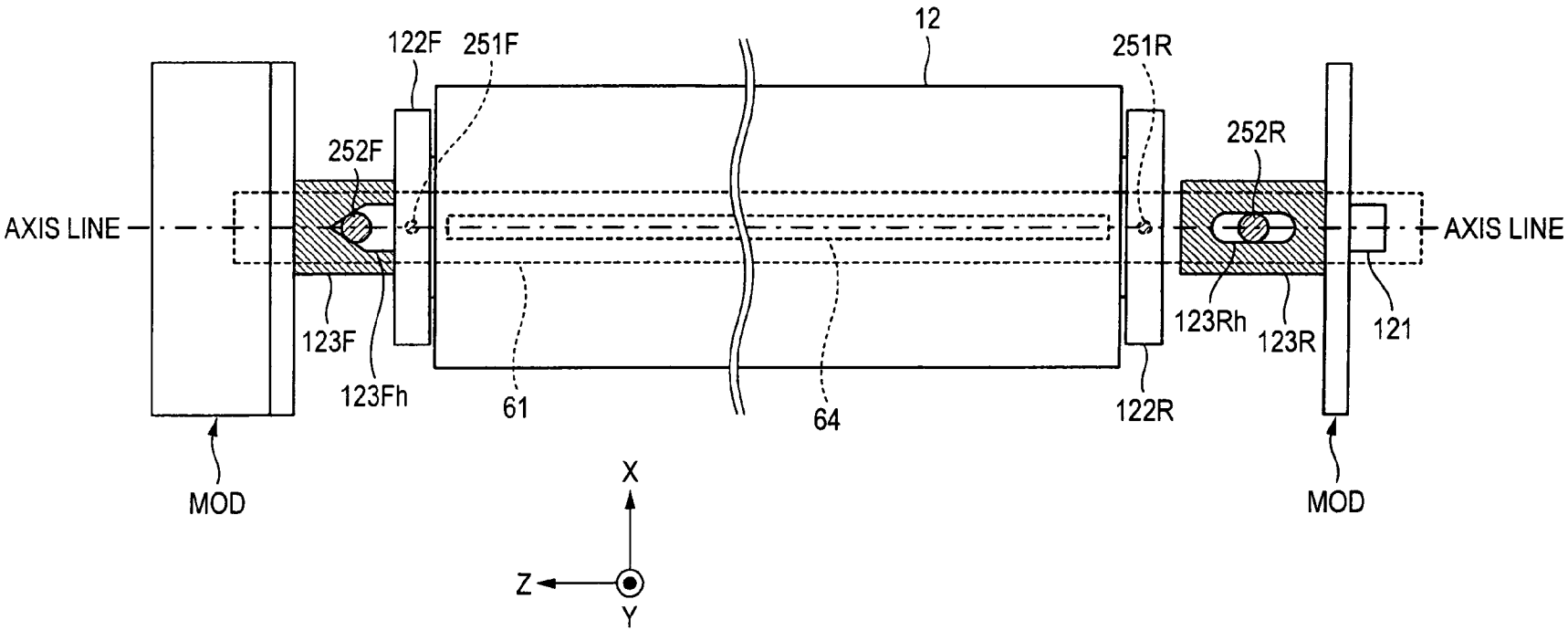
FIG. 7 is a view illustrating the positional relation among and the cross-sectional shapes of a photoreceptor drum, first projection members, Y-direction support members, second projection members, and XZ-direction support members in a state in which the LPH is set at an exposure position.

FIG. 7 is a view illustrating the positional relation among and the cross-sectional shapes of the photoreceptor drum 12, the first projection members 251F and 251R, the Y-direction support members 252F and 252R, the second projection members 252F and 252R, and the XZ-direction support members 123F and 123R in a state in which the LPH is set at an exposure position.

As shown in FIG. 7, a cross-sectionally V-shaped groove portion 123Fh having a substantially V-cross-sectional shape, which is formed symmetrically in the X-direction with respect to the axis line of the photoreceptor drum 12 so that a vertex is set on the axis line of the photoreceptor drum 12 in an X-plane, is formed in the XZ-direction support member 123F. This groove portion 123Fh supports the second projection member 252F, so that the center of the second projection member 252F is set on the axis line of the photoreceptor drum 12. That is, the LPH 14 is pushed in a direction (the Z-direction) from a rear surface side to the side of the XZ-direction by the press spring 212 serving as an example of the first pushing member provided in a body frame FRA. Thus, the second projection member 252F is pushed toward the XZ-direction support member 123F in the groove portion 123Fh of the XZ-direction support member 123F. Consequently, the second projection member 252F supports a V-shaped portion side surface of the groove portion 123Fh at two points. Thus, the center position of the second projection member 252F in the X-plane is set to coincide with the axis line position of the photoreceptor drum 12.

Incidentally, "the substantially V-cross-sectional shape of the groove portion 123 Fh" is a shape configured so that the distance between the two surfaces of the groove portion 123Fh in the X-plane is continuously reduced in a direction in which the press spring 212 is pushed.

A cross-sectionally substantially rectangular-shaped groove portion 123Rh having a substantially rectangle cross-sectional shape, whose both end portions are constituted by curves is formed in the XZ-direction support member 123R. The groove portion 123Rh is formed to have a width in the X-direction substantially equal to the outside diameter (i.e., a length obtained by adding a manufacturing tolerance to such an outside diameter) of the second projection member 252R.

Further, the groove portion 123Rh is formed to be symmetrical with respect to the axis line in the X-direction. Thus, the center of the second projection member 252R is set on the axis line of the photoreceptor drum 12 in the X-plane by inserting the second projection member 252R into this groove portion 123Rh, as illustrated in FIG. 5. That is, the position of the center of the second projection member 252R in the X-plane is set to coincide with the axis line position of the photoreceptor drum 12 while the position in the X-direction of the second projection member 252R is fixed by the groove portion 123Rh.

Thus, the positions of the center of each of the second projection members 252F and 252R in the X-plane is set on the axis line of the photoreceptor drum 12.

Also, the second projection member 252F is supported at two points in close contact with the side surfaces of the V-shaped portion of the groove portion 123Fh of the XZ-direction support member 123F. Thus, the Z-direction position of the LPH 14 is set with high accuracy at the Z-direction position determined by the position at which the groove portion 123Fh of the XZ-direction support member 123F is provided.

Additionally, the X-direction position of the second projection member 252R is fixed by the groove portion 123Rh. The second projection member 252F is pushed by the press spring 212 toward the groove portion 123Fh of the XZ-direction support member 123F, that is, toward the Z-direction. Thus, the X-direction position and the Z-direction position of the LPH 14 are fixed.

Also, as illustrated in FIG. 6, the second projection members 252F and 252R and the first projection members 251F and 251R are disposed on the rod lens array line. Thus, the positions of the centers of the second projection members 252F and 252R are set on the axis line of the photoreceptor drum 12 in the X-plane. Consequently, as illustrated in FIG. 7, the first projection members 251F and 251R abut against the Y-direction support members 122F and 122R on the axis line of the photoreceptor drum 12 in the X-plane.

Also, as illustrated in FIG. 5, the first projection members 251F and 251R are caused to abut against the Y-direction support members 122F and 122R on the axis line of the photoreceptor drum 12. Thus, the Y-direction position of the LPH 14 is set with high accuracy.

As described above, the image forming apparatus 1 according to the present embodiment uses the first projection members 251F and 251R and the Y-direction support members 122F and 122R, which are examples of the first positioning means for setting the Y-direction position of the LPH 14, and the second projection members 252F and 252R and the XZ-direction support members 123F and 123R, which are examples of the second positioning means for setting the XZ-direction position of the LPH 14. Thus, the position of the LPH 14 is determined with high accuracy with respect to the axis line of the photoreceptor drum 12 by separating the functions of such means from each other.

Further, the first projection members 251F and 251R and the Y-direction support members 122F and 122R, which are examples of the first positioning means for setting the Y-direction position of the LPH 14, are disposed closer to the rod lens array 64 than the second projection members 252F and 252R and the XZ-direction support members 123F and 123R, which are examples of the second positioning means for setting the XZ-direction position of the LPH 14. Consequently, the first projection members 251F and 251R are caused to abut against the Y-direction support members 122F and 122R at the side of the photoreceptor module MOD (see also FIG. 5), the first projection members 251F and 251R serve as supporting-points to suppress the rod lens array 64 from being bowed by the pushing force of the lifting spring 211 which will be described later.

Figure 8:
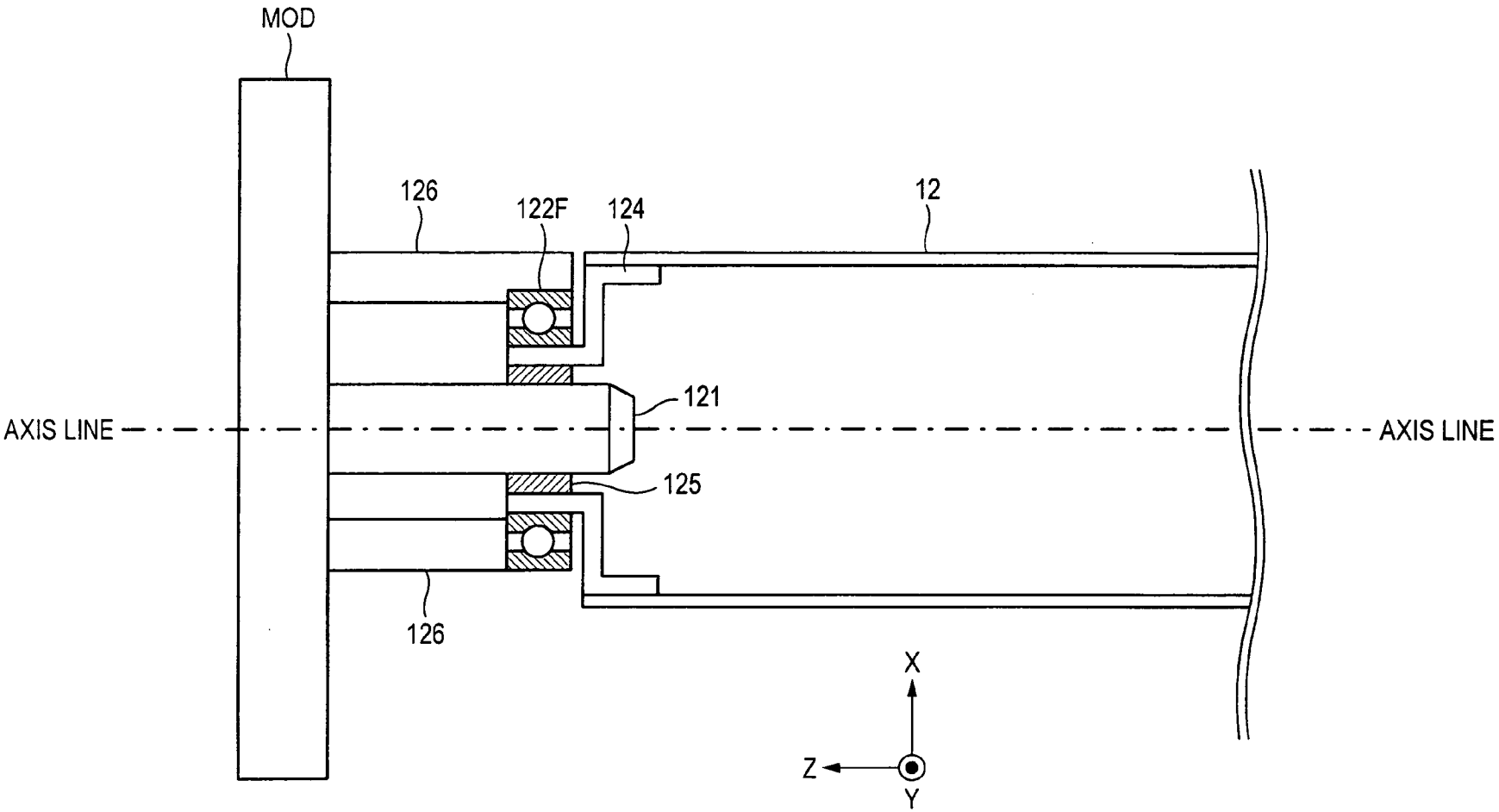
FIG. 8 is a cross-sectional view illustrating a region of a front-side end portion of the photoreceptor drum.

Meanwhile, the Y-direction support members 122F and 122R are disposed coaxially with the rotating shaft 121 of the photoreceptor drum 12, as illustrated in FIG. 8 which is a cross-sectional view of the front side portion of the photoreceptor drum 12. The Y-direction support members 122F and 122R are configured so that the positions of the surfaces thereof are set at predetermined positions from the axis line of the photoreceptor drum 12.

More specifically, at both end portions of the photoreceptor drum 12, flanges 124 are fit into the inner circumferential surface parts of the photoreceptor drum 12 so that the photoreceptor drum 12 and the flanges 124 are integral with one another. The flanges 124 have sintered bearings 125 provided in the inner circumferential parts thereof. The flanges 124 are axially supported by the rotating shaft 121 fixed to the photoreceptor module MOD through the sintered bearings 125. The flanges 124 support the photoreceptor drum 12 rotatably around the rotating shaft 121. Ball bearings are fit onto the outer circumferential surfaces of the flanges 124. According to the present embodiment, the ball bearings, which do not rotate as the photoreceptor drum 12 rotates, are used as the Y-direction support members 122F and 122R which support the first projection members 251F and 251R at the side of the LPH 14, so as to prevent reduction in the positioning accuracy from occurring as the photoreceptor drum 12 rotates. The Y-direction support members 122F and 122R are supported by bearing support members 126 provided on the photoreceptor module MOD.

With such a configuration, the photoreceptor drum 12 rotates while the flanges 124 formed integrally with the photoreceptor drum 12 are axially supported by the rotating shaft 121 fixed to the photoreceptor module MOD through the sintered bearings, and while the outer circumferential surfaces of the flanges 124 are axially supported by the ball bearings serving as the Y-direction support member 122F that is supported by the photoreceptor module MOD. Additionally, the apparatus can be manufactured so that the outside diameter of the rotating shaft 121, the inside diameters and the outside diameters of the sintered bearings 125, and the flanges 124 are set with good accuracy. Thus, the distance from each of the positions of the outer ring surface of the ball bearings serving as the Y-direction support members 122F and 122R to the axis line can be set with high accuracy. Consequently, the Y-direction position of the LPH 14 can be set with high accuracy by causing the first projection members 251F and 251R to abut against the outer ring surfaces of the Y-direction support members 122F and 122R constituted by the ball bearings.

Incidentally, the outer ring surfaces of the Y-directions support members 122F and 122R constituted by the ball bearings are supported by the bearing support members 126. Thus, the outer ring surfaces of the Y-directions support members 122F and 122R do not rotate. Therefore, the first projection members 251F and 251R do not abrade away. Consequently, the accuracy in the Y-direction position of the LPH 14 is suppressed from being reduced.

Next, the approaching/separating mechanism (i.e., the retracting mechanism) for the LPH 14 in the image forming apparatus 1 according to the present embodiment is described below.

As illustrated in FIG. 5, the image forming apparatus 1 according to the present embodiment has a guide bar 232 disposed by partly being to the housing 61 of the LPH 14, a slide roll 231 rotatably supported by the guide bar 232, the lifting springs 211 serving as the second pushing members adapted to upwardly push the housing 61 of the LPH 14, a retracting member 220 adapted to laterally slide-move to thereby move the LPH 14 in an up-down direction, a stage 221 adapted to guide the slide-movement of the slide-movement of the retracting member 220, the retracting handle 225 adapted to slide-move the retracting member 220, a guide member 240 adapted to guide the upward and downward movement of the LPH 14, and a stopper 230 serving as an example of movement limiting means adapted to limit the movement in the direction to the front side of the LPH 14, as the retracting mechanism.

Figure 9:
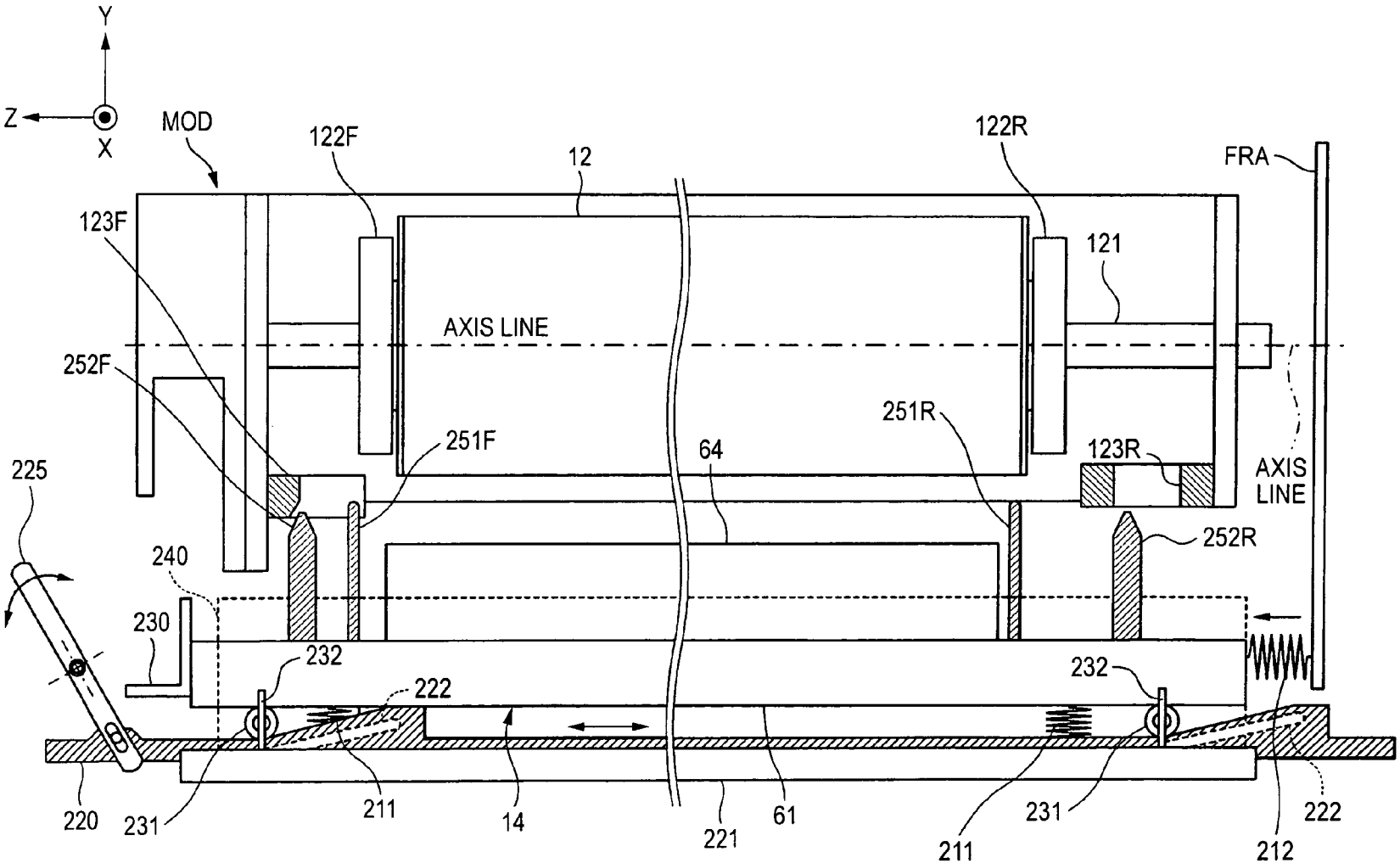
FIG. 9 is a view illustrating a state in which a retracting member is slide-moved from a front side to a rear side.

An operation of the retracting mechanism according to the present embodiment is described below. FIG. 5 illustrates a state in which the LPH 14 is set at the exposure position, as described above. The retracting member 220 slide-moves from the front side to the rear side by turning the retracting handle 225 clockwise, as viewed in FIG. 5. FIG. 9 illustrates this state.

When the retracting member 220 is slide-moved from the front side to the rear side, as illustrated in FIG. 9, the LPH 14 is lifted by the retracting member 220 is guided by the rail 222 formed on the side surface of the retracting member 220. The LPH 14 is pushed down against the pushing forces of the lifting springs 211. At that time, the LPH 14 is smoothly pushed down while the slide roll 231 rotates on a slope provided on the retracting member 22. Consequently, the LPH 14 is downwardly separated from the photoreceptor drum 12.

In this state, the first projection members 251F and 251R and the second projection members 252F and 252R are separated from the Y-direction support members 122F and 122R and the XZ-direction support members 123F and 123R, as illustrated in FIG. 9. At that time, the first projection members 251F and 251R and the second projection member 252R are completely detached from the Y-direction support members 122F and 122R and the XZ-direction support member 123R, respectively. That is, the first projection members 251F and 251R retreat to positions lower than the position of the surface of the photoreceptor drum 12. The second projection member 252R retreats to a position lower than the bottom surface of the XZ-direction support member 123R.

Figure 10:
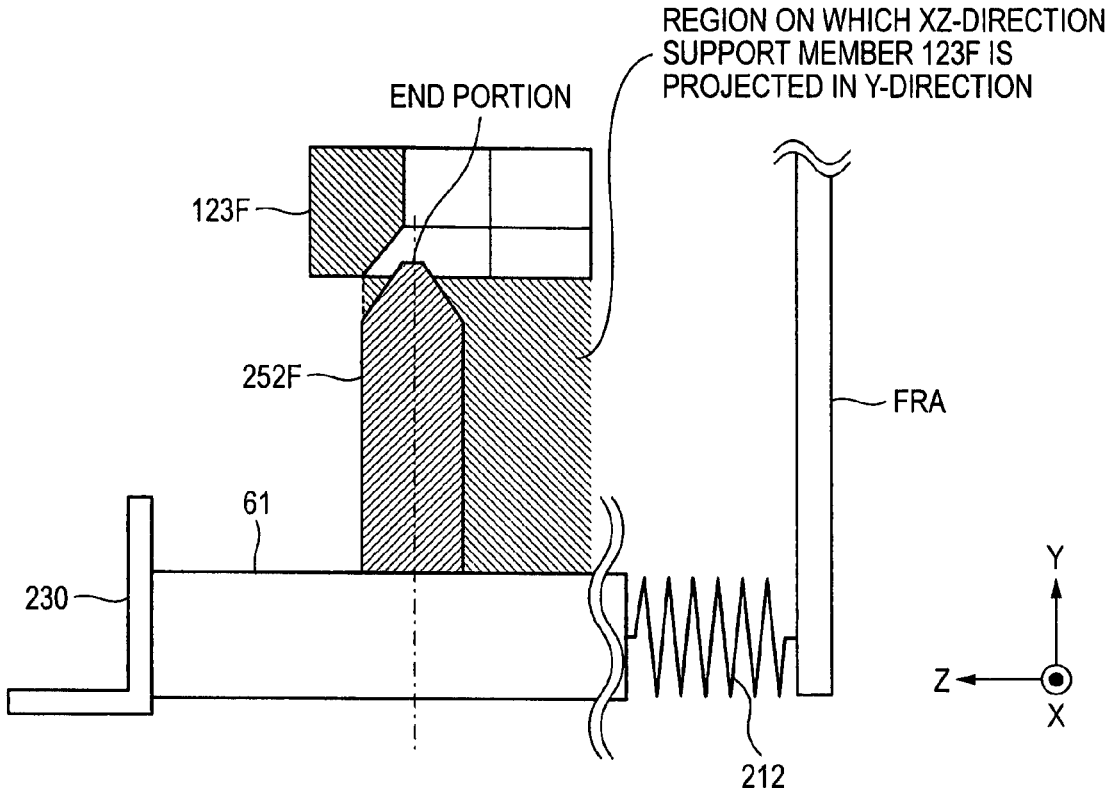
FIG. 10 is a view illustrating the relative positions of an end portion of the second projection member 252F and the XZ-direction support member 123F.

In contrast, the second projection member 252F is not completely detached from the XZ-direction support member 123F. That is, as illustrated in FIG. 10 illustrating the relative positions of the end portion of the second projection member 252F and the XZ-direction support member 123F, the end portion of the second projection member 252F is placed in a region to which the XZ-direction support member 123F is projected from the Y-direction. The second projection support member 252F retreats to a position higher than the bottom surface of the XZ-direction support member 123F at lowest.

That is, when the photoreceptor module MOD is attached to and detached from the apparatus, the first projection members 251F and 251R retreat to positions lower than the position of the surface of the photoreceptor drum 12. Also, the second projection member 252R is configured to retreat to a position lower than the bottom surface of the XZ-direction support member 123R. In contrast, the groove portion 123Fh of the second projection member 252F is opened to the rear side. Thus, even in a state in which the second projection member 252F is disposed at a position higher than the bottom surface of the XZ-direction support member 123F, the photoreceptor module MOD can be attached to and detached from the apparatus.

To set the LPH 14 at the exposure position shown in FIG. 5 again, the retracting handle 225 is once turned counterclockwise, as viewed in FIG. 9. Subsequently, the retracting handle 225 is returned to an original position shown in FIG. 5. Then, the retracting member 220 slide-moves from the rear side to the front side. Consequently, the guide bar 232 is guided by the rail 222 formed on a side surface of the retracting member 220. Consequently, the guide member 232 is pushed up by applying the pushing force of the lifting spring 211 thereto. At that time, the guide bar 232 is smoothly pushed up while the slide roll 231 rotates on the slope provided on the retracting member 220. Consequently, the LPH 14 is upwardly moved and is thus put into contact with the photoreceptor module MOD.

Then, the LPH 14 is put into contact with the photoreceptor module MOD. Thus, the first projection members 251F and 251R are caused to abut against the Y-direction support members 122F and 122R, respectively. The second projection members 252F and 252R are supported by the XZ-direction support members 123F and 123R.

In this state, the LPH 14 is pushed by the pushing force of the lifting spring 211 toward the photoreceptor drum 12. Thus, the Y-direction of the LPH 14 is fixed. Additionally, the X-direction and the Z-direction of the LPH 14 are fixed, as described above.

Meanwhile, as described above, to set the LPH 14 at the Z-direction position with high accuracy, it is necessary that the second projection member 252F is supported by being put into close contact with the side surfaces of the V-shaped part of the groove portion 123Fh at two points. Thus, the LPH 14 is pushed by the pressure spring 212 fixedly provided to the body frame FRA in the direction from the rear side toward the second projection member 252F.

However, the LPH14 is pushed by the press spring 212 from the rear side to the second projection member 252F. Thus, the LPH 14 is downwardly separated. When the LPH 14 is separated from the photoreceptor module MOD, the LPH 14 is pushed to the front side thereof. Consequently, the LPH 14 moves to the front side, and stops at a position at which the front side end portion of the LPH 14 is in contact with the front side end portion thereof. That is, in a case where the LPH 14 is downwardly separated, as illustrated in FIG. 9, the first projection members 251F and 251R and the second projection members 252F and 252R are placed by being shifted from positions, at which the Y-direction support members 122F and 122R and the XZ-direction support members 123F and 123R are disposed, toward the from t side in the Z-direction in the X-plane.

Therefore, in a case where the LPH 14 is upwardly in contact with the array and is set at the exposure position, the first projection members 251F and 251R and the second projection members 252F and 252R are set at the positions of the Y-direction support members 122F and 122R and the XZ-direction support members 123F and 123R, respectively, from the position shifted in the X-plane.

Thus, to smoothly set the first projection members 251F and 251R and the second projection members 252F and 252R at the positions of the Y-direction support members 122F and 122R and the XZ-direction support members 123F and 123R, respectively, from the position shifted in the X-plane, the groove portion 123Rh of the XZ-direction support member 123R supporting the second projection member 252R has a cross-sectional shape, whose width in the X-direction is longer than the width in the Z-direction, and is longer in length in the Z-direction than a shift distance in the X-plane at the time of operating the retracting handle 225.

However, as described above, the second projection member 252F is supported at two points on the V-shaped side surfaces of the groove portion 123Fh of the XZ-direction support member 123F by being in contact with while is pushed by the press spring 212. Consequently, the Z-direction position of the LPH 14 is set with high accuracy. Accordingly, it is impossible to design the groove portion 123Fh of the Y-direction support member 123F to have a margin of the length in the Z-direction in the X-plane. Thus, the image forming apparatus 1 according to the present embodiment is set so that even when the LPH 14 retreats from the exposure position, an end portion of the second projection member 252F is placed in a region onto which the XZ-direction support member 123F is projected from the Y-direction, and that the second projection member 252F is retreated to a position higher than the bottom surface of the XZ-direction support member 123F at lowest.

Figure 11A:
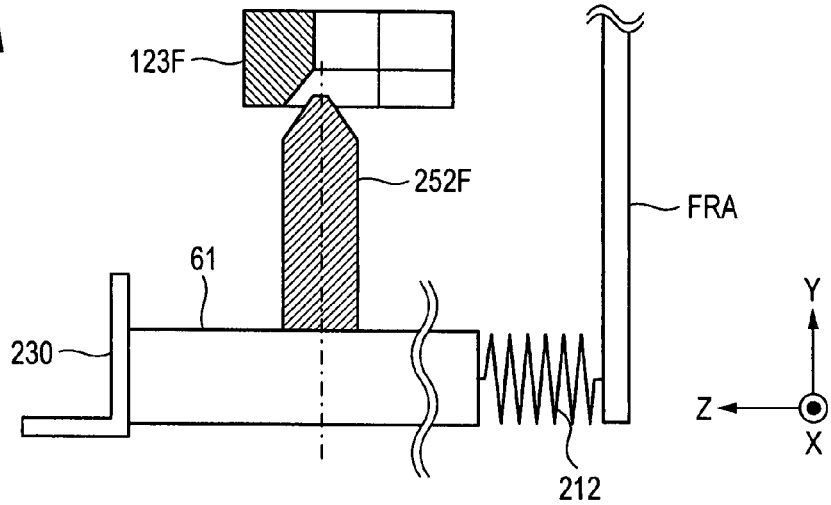
FIGS. 11A, 11B, and 11C are views illustrating the relative positional positions of the first projection member and the XZ-direction support member when the LPH is moved from a position, at which the LPH is detached from a photoreceptor module and is set at an exposure position.
Figure 11B:
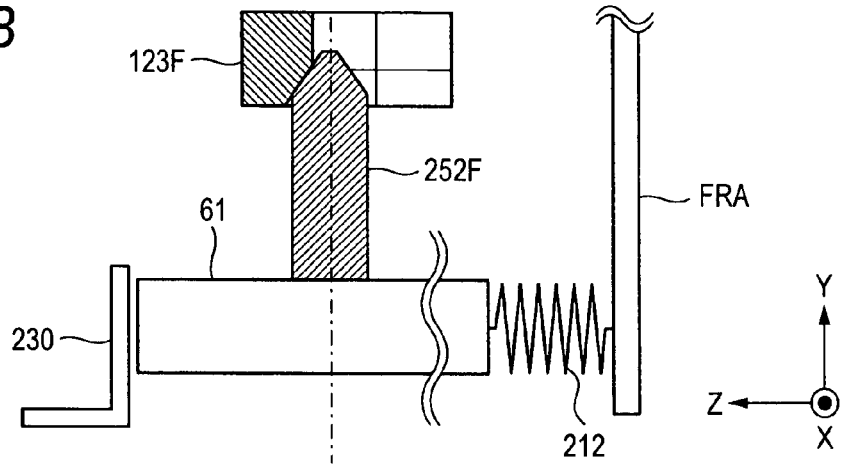
Figure 11C:
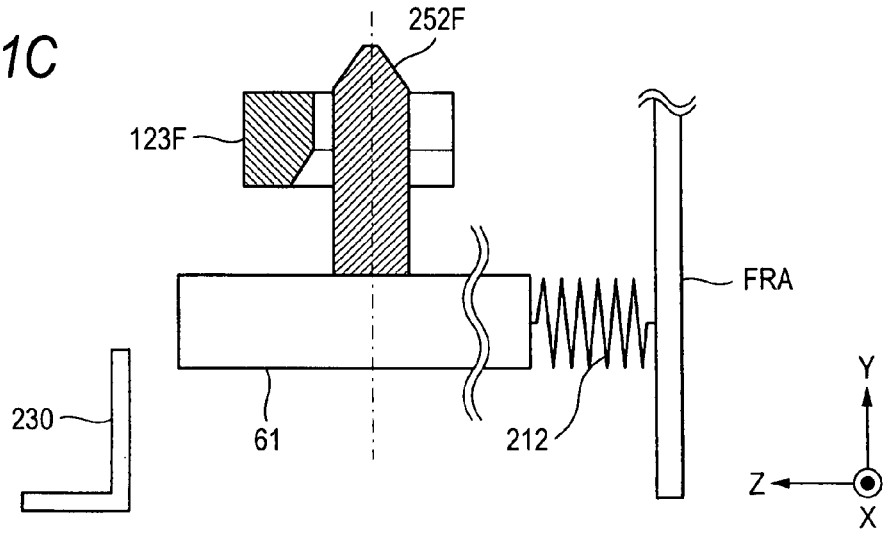

That is, FIGS. 11A to 11C illustrate the relative positional relation between the second projection member 252F and the XZ-direction support member 123F when the LPH 14 is set at the exposure position from a position at which the LPH 14 is separated from the photoreceptor module MOD. As illustrated in FIG. 11A, the top portion of the second projection member 252F is placed higher than the bottom surface of the XZ-direction support member 123F at the position, at which the LPH 14 is separated from the photoreceptor module MOD. That is, the top portion of the second projection member 252F is placed in the XZ-direction support member 123F. Thus, even in a case where the LPH 14 is shifted to the front side in the Z-direction in the X-plane, when the LPH 14 is upwardly moved by the retracting mechanism, the LPH 14 is surely guided in the groove portion 123Fh of the Y-direction support member 123F. In such a case, a tapered portion is formed at the top part of the second projection member 252F and at the lower part of the groove portion 123Fh of the XZ-direction support member 123FR. Thus, the second projection member 252F can be more surely and smoothly guided to the groove portion 123Fn of the XZ-direction support member 122.

As illustrated in FIG. 11B, the retracting mechanism starts to upwardly move the LPH 14, and thus, the LPH 14 starts to upwardly move, the second projection member 252F upwardly moves in the groove portion 123Fh along the side surface of the groove portion 123Fh of the XZ-direction support member 123F. Then, as illustrated in FIG. 11C, when the LPH 14 is set at the exposure position, the second projection member 252F is set at a position at which the second projection member 252F is supported at two points on and is in close contact with the V-shaped side surfaces of the groove portion 123Fh of the XZ-direction support member 123F while pushed in the direction toward the front side by the press spring 212.

Figure 12:
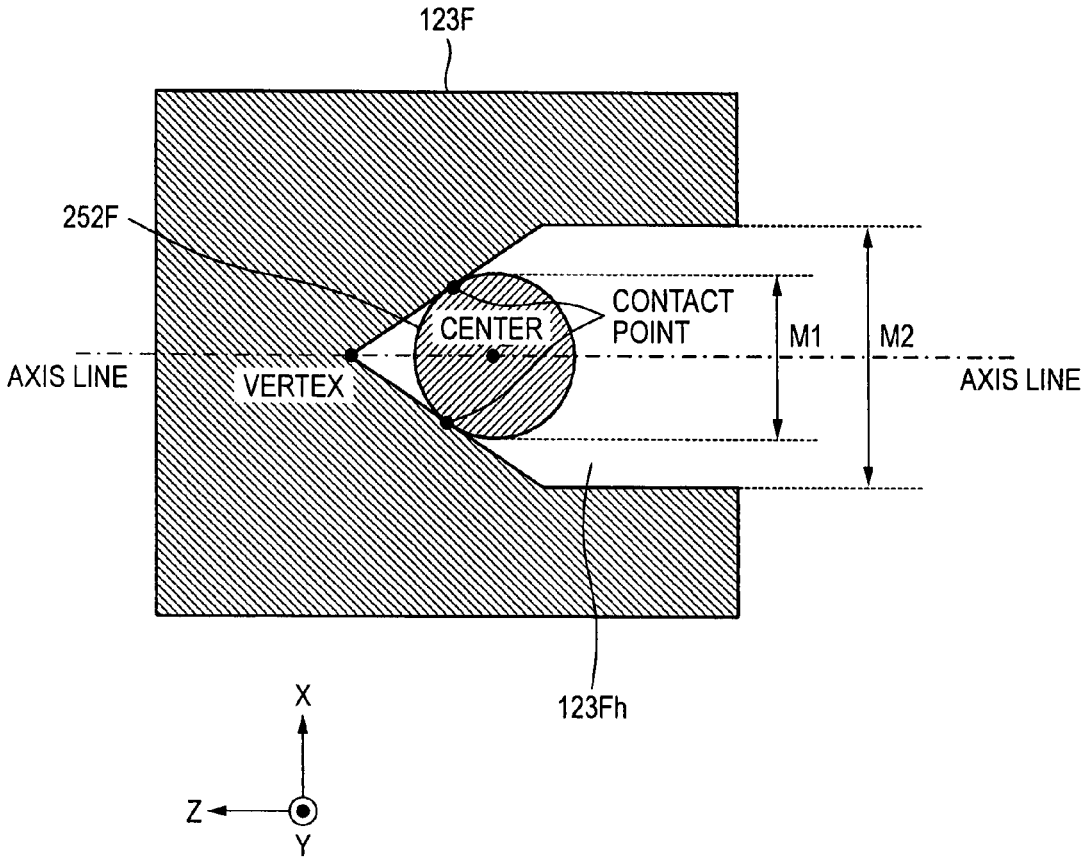
FIG. 12 is a cross-sectional view illustrating a state in which the first projection member is supported by the XZ-direction support member.

The second projection member 252F is supported at two points on and is in close contact with the side surfaces of the V-shaped part of the groove portion 123Fh of the XZ-direction support member 123F. Thus, as illustrated in FIG. 12 which is a cross-sectional view illustrating a state in which the second projection member 252F is supported by the XZ-direction support member 123F, the groove portion 123Fh is formed so that the opening width M2 of the V-shaped portion thereof is larger than the outside diameter M1 of the second projection member 252F. In a case where the opening width M2 of the V-shaped portion of the groove portion 123Fh is substantially equal to the outside diameter M1 of the second projection member 252F, the second projection member 252F is in contact with the V-shaped side surfaces at four contact points or is in contact with side surfaces at the front of the V-shaped side surfaces at two contact points. In this case, the LPH 14 cannot be set at desirable positions in the Z-direction and in the X-direction.

Figure 13B:
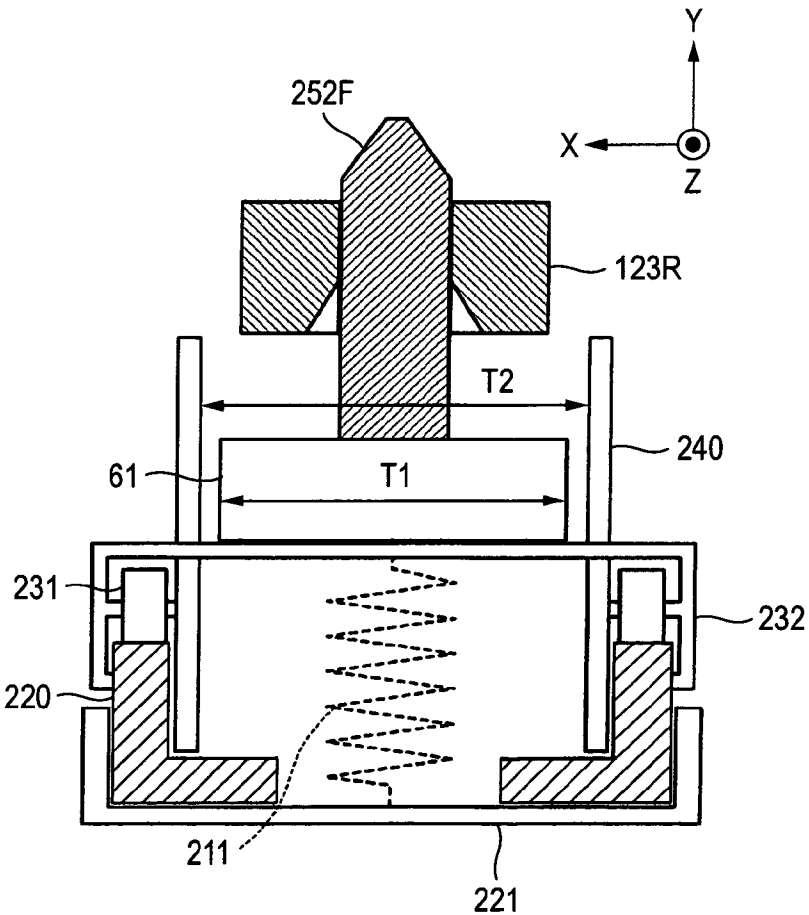
FIG. 13B is a cross-sectional view taken on line N-N shown in FIG. 5.
Figure 13A:
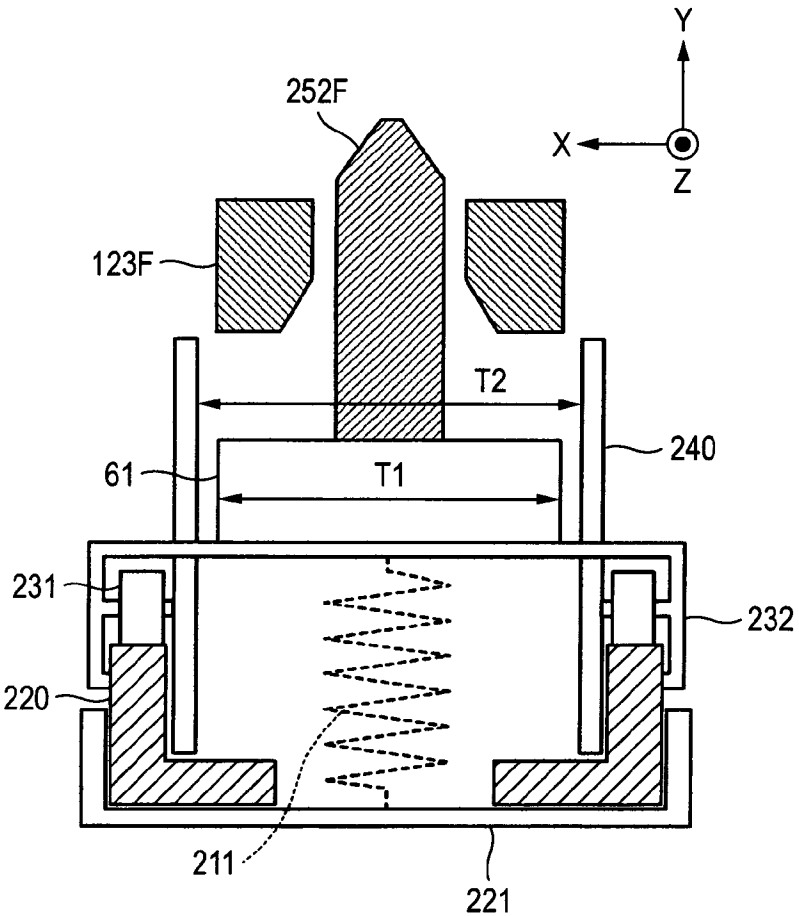
FIG. 13A is a cross-sectional view taken on line L-L shown in FIG. 5.

Also, the above retracting mechanism according to the present embodiment is configured so that the width of the guide member 240 is larger than the width of the housing 61 of the LPH 14. FIG. 13A is a cross-sectional view taken on line L-L shown in FIG. 5. FIG. 13B is a cross-sectional view taken on line N-N shown in FIG. 5. As illustrated in FIG. 13A, the retracting mechanism is formed so that the width T2 of the guide member 240 is larger than the width T1 of the housing 61 of the LPH 14. When an approaching/separating operation is performed, the degree of freedom in the X-direction of the LPH 14 increases. Consequently, the second projection member 252F is smoothly supported at two points on the V-shaped portion side surfaces of the groove portion 123Fh of the XZ-direction support member 123F, whose lower part is tapered.

Additionally, even in the second projection member 252R, a lower part of the groove portion 123Rh of the XZ-direction support member 123R, whose width in the X-direction is substantially equal to the outside diameter of the first projection member 251R, is tapered. Also, when the LPH 14 is in contact with the array, the LPH 14 has a degree of freedom of movement in the X-direction. Thus, the second projection member 252R, whose top part is tapered, is smoothly supported by the groove portion 123Rh of the XZ-direction support member 123R.

Incidentally, in the image forming apparatus 1 according to the present embodiment, the first projection members 251F and 251R are configured separately from the second projection members 252F and 252R. When the first positioning means and the second positioning means are configured, the first support member is constituted separately from the second support member. The first projection member 251F and the second projection member 252F are formed integrally with the first projection member 251R and the second projection member 252R, respectively. Thus, the apparatus may be configured so that the Y-direction, the X-direction, and the Z-direction can be set using only one projection portion.

In the foregoing description of the image forming apparatus according to the present embodiment, this image forming apparatus 1 has been described, which is configured so that the Y-direction support members 122F and 122R, the XZ-direction support members 123F and 123R are provided at the side of the photoreceptor module MOD. However, in a case where the Y-direction support members 122F and 122R, and the XZ-direction support members 123F and 123R can maintain a predetermined positional relation with the photoreceptor drum 12, the Y-direction support members 122F and 122R, and the XZ-direction support members 123F and 123R can be provided at the side of the body of the image forming apparatus 1.

As described above, in the image forming apparatus according to the present embodiment, the first projection members 251F and 251R at the side of the LPH 14 abut against the Y-direction support members 122F and 122R provided at the side photoreceptor module MOD, respectively. Thus, the position in the Y-direction of the LPH 14 is set. Simultaneously with this, the second projection members 252F and 252R at the side of the LPH 14 are supported by the XZ-direction support members 123F and 123R provided at the side of the photoreceptor module MOD, respectively. Consequently, the position in the X-direction and the position in the Z-direction of the LPH 14 are simultaneously set. Then, the first projection members 251F and 251R are disposed closer to the rod lens array 64 than the second projection members 252F and 252R. Consequently, the image forming apparatus according to the present embodiment can suppress flexure of the rod lens array 64 caused when the first projection members 251F and 251R are caused to abut against the Y-direction support members 122F and 122R at the side of the side of the photoreceptor module MOD. Also, the positioning of the LPH 14 with respect to the photoreceptor drum 12 can be achieved with good accuracy.

Thus, a high-quality image with extremely small skew and distortion can be formed.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder;

an exposure member that has an exposure portion exposing the image holder;

a first positioning unit that determines a distance in a first direction, which is a direction of an optical axis of the exposure member, between the exposure member and the image holder; and a second positioning unit that determines a position of the exposure member with respect to the image holder in a second direction being a direction of an axis line of the image holder, and a position of the exposure member with respect to the image holder in a third direction, the third direction being perpendicular to both the first direction and the second direction, wherein the first positioning unit is disposed closer to the exposure member than the second positioning unit at a same side of the exposure member, wherein the first positioning unit is disposed closer with respect to the second direction to the exposure member than the second positioning unit as a same side of the exposure member with respect to the second direction.

2. The image forming apparatus as claimed in claim 1, wherein the first positioning unit comprises:

a first projection portion that is provided at a side of the exposure member to project from the exposure member to the image holder; and a first support portion that supports the first projection portion at a side of the image holder, and the second positioning unit comprises:

a second projection portion that is provided at a position, which is farther from the exposure member in the second direction than the first projection portion, at a side of the exposure member to project from the exposure member to the image holder; and a second support portion that supports the second projection portion at a side of the image holder.

3. The image forming apparatus as claimed in claim 1, further comprising a first pushing member that pushes the exposure member in the second direction, wherein the first positioning unit comprises:

a first projection portion that is provided at a side of the exposure member to project from the exposure member to the image holder; and a first support portion that supports the first projection portion at a side of the image holder, and the second positioning unit comprises:

a third projection portion that is provided at a position, which is farther from the exposure portion in the second direction than the first projection portion, at a side of the exposure member to project from the exposure member to the image holder; and a third support portion that supports the third projection portion at a side of the image holder, and that have two surfaces determining a position of the third projection portion in the second direction and a position of the third projection portion in the third direction by causing the first pushing member to push the exposure member in the second direction, wherein the two surfaces of the third support member are configured so that a distance in the third direction between the two surfaces continuously decreases toward a pushing direction of the first pushing member, define an opening portion at which the distance in the third direction between the two surfaces has a maximum value, and are configured to be larger than a width of the third projection portion in the third direction.

4. The image forming apparatus as claimed in claim 3, wherein the exposure member is contactable with and separatable from the image holder in the first direction, and a movement limiting unit limits movement in the second direction of the exposure member so that an end part of the third projection portion is placed in a region, onto which the third support portion is projected from the first direction, in a state where the exposure member is moved far from the image holder.

5. The image forming apparatus as claimed in claim 3, wherein the exposure member is movable with respect to the image holder in the first direction, and a movement limiting unit limits movement in the second direction of the exposure member so that an end part of the third projection portion is placed in the second support portion in a state where the exposure member is moved far from the image holder.

6. The image forming apparatus as claimed in claim 5, further comprising an image holding replacement unit that includes the image holder, and that is attached to and detached from the image forming apparatus by being moved in the second direction to the image forming apparatus integrally with the image holder, wherein the third support portion is provided at a side of a body of the image forming apparatus.

7. The image forming apparatus as claimed in claim 1, further comprising a third positioning unit on an opposite side of the image holder from the first positioning unit such that the first and third positioning units define a first pair of positioning units that determine the distance in the first direction between the exposure member and the image holder.

* * * * *